United States Patent [19]

Cheng et al.

[11] Patent Number: 4,600,496

[45] Date of Patent: Jul. 15, 1986

[54] PITCH CONVERSION

[75] Inventors: Paul J. Cheng; Tammy M. Elkins, both of Bartlesville, Okla.

[73] Assignee: Phillips Petroleum Company, Bartlesville, Okla.

[21] Appl. No.: 553,446

[22] Filed: Nov. 18, 1983

Related U.S. Application Data

[63] Continuation-in-part of Ser. No. 498,450, May 26, 1983, abandoned.

[51] Int. Cl.[4] ..... C10C 3/02

[52] U.S. Cl. ..... 208/44; 208/22

[58] Field of Search ..... 208/44, 22

[56] References Cited

U.S. PATENT DOCUMENTS

| | | | |
|---|---|---|---|
| 3,244,543 | 4/1966 | Lifson et al. | 208/44 X |
| 3,258,418 | 6/1966 | Pitchford et al. | 208/44 |
| 3,809,565 | 4/1973 | Wewerka et al. | 106/56 |
| 3,839,190 | 2/1973 | Frese et al. | 208/44 |
| 4,005,183 | 1/1977 | Singer | 208/44 X |
| 4,042,486 | 8/1977 | Asano et al. | 208/44 |
| 4,414,095 | 11/1983 | Dickakian | 208/44 |

FOREIGN PATENT DOCUMENTS

| | | | |
|---|---|---|---|
| 0127151 | 12/1984 | European Pat. Off. | 208/44 |
| 2559537 | 2/1977 | Fed. Rep. of Germany | 208/44 X |
| 2559536 | 2/1977 | Fed. Rep. of Germany | 208/44 |
| 0214531 | 12/1983 | Japan | 208/44 |
| 0122586 | 7/1984 | Japan | 208/44 |

*Primary Examiner*—Andrew H. Metz
*Assistant Examiner*—O. Chaudhuri
*Attorney, Agent, or Firm*—Howard D. Doescher

[57] ABSTRACT

Pitch is converted to mesophase pitch in the presence of catalytically effective amounts of oxides, diketones, carboxylates and carbonyls of metals selected from vanadium, chromium, molybdenum, iron, nickel and cobalt. The crystalloidal or mesophase pitch obtained can be used for the production of carbon fibers and other carbon and graphite products and articles of manufacture of unusually high quality.

11 Claims, No Drawings

PITCH CONVERSION

This is a continuation-in-part application of our copending application having Ser. No. 498,450, filed May 26, 1983, entitled "Pitch Conversion", now abandoned.

This invention relates to a process for the conversion of pitch into crystalloidal or mesophase pitch. In accordance with another aspect, this invention relates to a process for the conversion of plain pitch into mesophase pitch in the presence of a novel catalyst. In accordance with another aspect, this invention relates to an improved process for converting petroleum pitch to mesophase pitch in the presence of a metal oxide or metal organic salt catalyst which are effective for the conversion of pitch to mesophase pitch. In accordance with another aspect, this invention relates to a process for the production of mesophase pitch which serves as a precursor for carbon fibers and other carbon products.

Generally speaking ordinary pitch has an amophorous structure. When this pitch is heated to temperatures at least about 350° C. in an inert gas atmosphere the molecules of the pitch undergo a thermal polycondensation reaction and become oriented to give rise to a kind of optically isomeric liquid crystal within the pitch. This liquid crystal is otherwise called a mesophase. A mesophase consists of pitch-forming aromatic molecules which generally have been oriented and associated together through their own interaction. Generally, the mesophase can be observed as anisotropic spherules under a polarizing microsope. A pitch of the type which contains such a mesophase is referred to as "crystalloidal pitch".

Mesophase pitch containing oriented liquid polyaromatic crystals is the starting material for the preparation of carbon fibers by extrusion and subsequent carbonization. It is desirable to produce high quality mesophase pitch to facilitate the production of carbon fibers. The present invention is related and directed to a process for the production of mesophase pitch by a catalytic process which yields a desirable product which can be readily used subsequently in the preparation of carbon fibers and other carbon products.

Accordingly an object of this invention is to provide an improved process for the production of mesophase pitch.

Another object of this invention is to provide a catalyst effective for the production of mesophase pitch.

Another object of this invention is to provide a catalyzed process for producing mesophase pitch that can be formed into fibers and other carbon products exhibiting desirable properties.

Other objects, aspects as well as the several advantages of the invention will be apparent to those skilled in the art upon reading the specification and the appended claims.

According to the invention a process is provided for converting pitch to mesophase pitch comprising heating pitch in the presence of a catalytically effective amount of an oxide or an organic salt of a metal effective for the conversion of the pitch.

Further, in accordance with the invention, a catalyzed process is provided for producing a mesophase pitch that can be formed into fibers and other carbon products having improved properties in comparison with uncatalyzed mesophase pitch. Specifically, fibers formed from catalyzed pitch of the invention exhibit higher tensile strengths and lower modulus values than fibers formed from uncatalyzed pitch.

More specifically, the instant process comprises heating pitch in the presence of a catalyst selected from the group consisting of oxides of vanadium, chromium, iron and cobalt (preferably $V_2O_5$, $Cr_2O_3$, $Fe_2O_3$, $Co_3O_4$), diketones of vanadium, chromium and nickel (preferably vanadium(III) acetylacetonate, vanadyl(IV) acetylacetonate = $VO(acetylacetonate)_2$, nickel(II) acetylacetonate, chromium(III) acetylacetonate), carboxylates of nickel and cobalt (preferably cobalt (II) octoate, cobalt(II) naphthenate, nickel(II) octoate and nickel(II) naphthenate), and carbonyls of molybdenum (preferably molybdenum hexacarbonyl). Most preferred is $VO(acetylacetonate)_2$. Preferably the pitch is heated to a temperature of at least 350° C.

As the raw material for the present invention various types of pitch such as, for example, coal tar pitch, petroleum pitch, and any pitches produced as by-products in chemical industries can be used. For ease of handling and for smooth operation during heat treatment it is desirable to use pitch having a softening point of not less than about 70° C. Most pitches are solid and accordingly it is desirable to use particulate pitch during heat treatment. This can be accomplished by simply crushing or grinding the pitch raw material.

The actual heat treating can be carried out in a batch or continuous type of operation. Moreover a fixed bed of pitch whether particulate or chunks can be subjected to heat treatment in the presence of the catalyst of the invention. It is also within the scope of the invention to treat molten pitch containing the catalyst to cause conversion of the pitch to mesophase pitch. In the presently preferred mode, the pitch and the catalyst, optionally dissolved in a solvent, are mixed and heated in a stirred kettle in an inert gas atmosphere for a period of time sufficient to accomplish conversion to mesophase pitch while volatiles are distilled off.

The catalyst components are known and can be prepared in the usual manner for the preparation of oxides and organic salts of these metals.

The amounts of the catalysts employed during conversion of the pitch can vary appreciably depending upon the catalyst component, reaction conditions, as well as mode of contact, but in all instances there will be present catalytically effective amounts of at least one of the catalyst components. Broadly, there will be present at least about 0.1 weight percent of the catalyst based upon the weight of pitch being converted. The maximum amount of catalyst used will depend upon catalyst activity and economics and can range up to about 20 weight percent. The practical amounts employed for the catalysts can vary depending upon the particular catalyst group being used. As shown in the specific working examples, effective amounts of catalyst can range from about 2 to about 5 weight percent for the oxides, from about 0.2 to about 16 weight percent for the diketones, from about 1 to about 4 weight percent for the carboxylates, and from about 2 to about 3 weight percent for the carbonyls.

In accordance with the invention pitch is subjected to a heat treatment at an elevated temperature of at least about 350° C. and for a period of time sufficient to convert the pitch to mesophase pitch. It is generally preferred to carry out the heating in the presence of a non-oxidative gas. Examples of non-oxidative gases which serve the purpose herein include nitrogen, argon, steam and complete combustion gases. The temperature which the heat treatment is carried out generally falls within the range of about 380° to about 450° C. The heat treatment time can be suitably selected in accordance with the temperature to be used. Ordinarily the time required ranges from about 1 to about 20 hours.

The crystalloidal pitch or mesophase pitch obtained according to the invention can be used for the production of carbon fibers and other articles of manufacture of carbon and graphite products of unusually high quality and therefore can be used extensively in the field of electrical products and in the field of mechanical products, such as seals, bearings and shafts in the field of chemical products, such as impervious and anticorrosive containers, and in the field of aerospace applications.

In one embodiment, the general procedure for the spinning of mesophase pitch such as the catalyzed mesophase pitch prepared according to this invention, and the subsequent carbonization graphitization of the spun fibers for making carbon fibers is described. Generally mesophase pitch (catalyzed or uncatalyzed) is heated to about 300°–400° C., i.e. well above its softening point, screened through a suitable screen pack and extruded through a spinnerette with one or more holes. This spinning operation is carried out in an inert gas atmosphere so as to avoid oxidative degradation of the mesophase pitch material.

The cooled pitch fibers can then be wound up and are then passed through a thermoset zone into a carbonization and/or graphitization furnace for making carbon fibers useful for polymer reinformcement end uses. In the first phase of the fiber forming process, the pitch fiber is thermoset in an oxygen containing gas (e.g., air) at a temperature of about 250°–350° C. The thermoset mesophase pitch fiber is carbonized at about 1000° C. and then further carbonized and/or graphitized at a temperature ranging from about 1500° C. to about 3000° C., at present preferably about 1800°–2000° C. The diameter of carbon fibers generally ranges from about 5 microns to about 50 microns.

The present invention will be described more specifically below by reference to preferred embodiments of the invention. It should be noted, however, that the present invention is not limited in any way by these examples.

EXAMPLE I

In this example the conversion of Mobilbond 120 petroleum pitch (having a softening point of about 256° F., a specific gravity of 1.1873, an average molecular weight of 521, an ash content of 0.17 weight-%, 91.81 weight-% C, 6.18 weight-% H, 0.20 weight-% N and 1.05 weight-% S; marketed by Mobil Oil Corporation, Beaumont, Tex.) to anisotropic mesophase pitch is described. 6 grams of crushed petroleum pitch and (when used) variable amounts of catalysts were placed in a clean ceramic boat (10.5 cm×2.2 cm×1.5 cm), which was pushed into the center of a quartz tube sealed on one end with a rubber stopper. A thermocouple was introduced through a hole in the stopper into the quartz tube and was positioned so as to touch the pitch. The quartz tube was insulated with glass wool and was placed into a Lindberg Model 54331 tube furnace (marked by Lindberg, a unit of General Signal), Watertown, Wis. 53094) such that both ends of the quartz tube protruded from the furnace. The protruded ends were wrapped with aluminum foil. Two additional thermocouples were attached to the quartz tube and were interfaced with a Type 125 Eurotherm Programmer (marketed by Eurotherm Corp., Reston, Va. 22090) for controlling the rate of heating the furnace.

Nitrogen gas was introduced at a rate of about 280 cc/minute through the inlet end of the quartz tube and exited through the hole in the stopper at the other end of the tube. The exit gas was passed through 3 traps in series to detect clogging and to collect volatiles.

The pitch was heated at variable temperatures for about 4 hours 50 minutes. After cooling the ceramic boat was weighed, and the %-weight loss of the sample was determined. The amount of mesophase pitch in the heat-treated petroleum pitch was determined by the "quinoline insolubles" (QI) test (ASTM D2318).

EXAMPLE II

Results of heat-treatment tests described without catalysts and with a number of transition metal compounds as catalysts are listed in Table I.

TABLE I

| Run | Catalyst | Wt-% Wt %[1] Catal. | Reaction Temp (°C.) | Weight Loss (Wt &) | QI[2] (Wt %) | Mesophase Yield (Wt %) |
|---|---|---|---|---|---|---|
| 1 (Control) | — | — | 410 | 49 | 27.3 | 13.9 |
| 2 (Control) | — | — | 410 | 46.9 | 18.6 | 9.9 |
| 3 (Control) | — | — | 410 | 48.5 | 30.6 | 15.8 |
| 4 (Control) | — | — | 410 | 49.9 | 46.7 | 23.4 |
| 5 (Control) | — | — | 410 | 49.3 | 44.6 | 22.6 |
| 6 (Control) | — | — | 410 | 48.2 | 31 | 16.1 |
| 7 (Control) | — | — | 410 | 49.3 | 40.8 | 20.7 |
| 8 (Control) | — | — | 410 | 49 | 30.2 | 15.4 |
| 9 (Control) | — | — | 410 | 49.5 | 35.4 | 17.9 |
| 10 (Control) | $Nd_2O_3$→ | 1.9 | 410 | 48.9 | 27.9 | 14.3 |
| 11 (Invention) | $V_2O_5$ | 5.0 | 410 | 41.9 | 52.8 | 30.7 |
| 12 (Invention) | $V_2O_5$ | 5.0 | 410 | 44 | 86 | 48.2 |
| 13 (Invention) | $V_2O_5$ | 5.0 | 410 | 42 | 70.7 | 41 |
| 14 (Invention) | $V_2O_5$ | 3.0 | 410 | 44.6 | 67.4 | 37.3 |
| 15 (Invention) | $V_2O_5$ | 2.0 | 410 | 45.2 | 48 | 26.3 |
| 16 (Invention) | $V_2O_5$ | 5.0 | 400 | — | 48.2 | — |
| 17 (Invention) | $Cr_2O_3$ | 4.1 | 410 | — | 60.6 | — |
| 18 (Invention) | $Fe_2O_3$ | 4.2 | 410 | — | 76.7 | — |
| 19 (Invention) | $Co_3O_4$ | 4.3 | 410 | 44 | 70.6 | 39.5 |
| 20 (Invention) | $V(acac)_3$[4] | 15.0 | 410 | 42.5 | 97.1 | 55.8 |
| 21 (Invention) | $V(acac)_3$ | 16.0 | 410 | 43.3 | 99.3 | 56.3 |
| 22 (Invention) | $VO(acac)_2$[5] | 12.8 | 410 | 38.5 | 99.5[13] | 61.2 |
| 23 (Invention) | $VO(acac)_2$ | 12.6 | 410 | 38.7 | 100[13] | 61.3 |
| 24 (Invention) | $VO(acac)_2$ | 6.7 | 410 | 39.7 | 99.1[13] | 59.8 |

TABLE I-continued

| Run | Catalyst | Wt-% Wt %[1] Catal. | Reaction Temp (°C.) | Weight Loss (Wt &) | QI[2] (Wt %) | Mesophase Yield (Wt %) |
|---|---|---|---|---|---|---|
| 25 (Invention) | $VO(acac)_2$ | 3.5 | 410 | 39.6 | 99.1[13] | 59.9 |
| 26 (Invention) | $VO(acac)_2$ | 1.86 | 410 | 40.2 | 99.2[13] | 59.3 |
| 27 (Invention) | $VO(acac)_2$ | 0.89 | 410 | 43.5 | 99 | 65.8 |
| 28 (Invention) | $VO(acac)_2$ | 0.45 | 410 | 46.5 | 87.6 | 46.9 |
| 29 (Invention) | $VO(acac)_2$ | 0.26 | 410 | 48.1 | 56.6 | 29.4 |
| 30 (Invention) | $Cr(acac)_3$[6] | 0.63 | 410 | 49 | 45.1 | 23 |
| 31 (Invention) | $Cr(acac)_3$ | 1.26 | 410 | 48.9 | 60.1 | 30.7 |
| 32 (Invention) | $Ni(acac)_2.2\ H_2)O$[7] | 0.54 | 410 | 46.1 | 54.1 | 29.2 |
| 33 (Invention) | $Ni(acac)_2.2\ H_2O$ | 1.02 | 410 | 46.3 | 74.5 | 40 |
| 34 (Invention) | $Ni(acac)_2.2\ H_2O$ | 2.1 | 410 | 45.1 | 89.6 | 49.2 |
| 35 (Control) | $Nd(acac)_3$[8] | 1.93 | 410 | 48.8 | 27.1 | 13.9 |
| 36 (Control) | $NdCl_3.CH_2O$ | 2.05 | 410 | 50.1 | — | — |
| 37 (Control) | $VO(naphth)_3$[9] | 2.00 | 410 | 48.1 | 20.8 | 10.8 |
| 38 (Invention) | $Co(naphth)_2$[10] | 1.96 | 410 | 39.5 | 69.8 | 42.2 |
| 39 (Invention) | $Co(naphth)_2$ | 1.95 | 410 | — | 72.4 | — |
| 40 (Invention) | $Ni(naphth)_2$[11] | 2.09 | 410 | 43.9 | 82.6 | 46.3 |
| 41 (Invention) | $Mo(CO)_6$ | 2.68 | 410 | 49.8 | 76.5 | 38.4 |
| 42 (Invention) | $Mo(CO)_6$ | 2.00 | 410 | 48.4 | 68.4 | 35.3 |
| 43 (Invention) | $Ni(octoate)_2$ | 2.66 | 410 | 42.8 | 92.3 | 52.8 |
| 43A (Invention) | $Ni(octoate)_2$ | 2.14 | 410 | 43.7 | 98.2 | 55.3 |
| 44 (Invention) | $Co(octoate)_2$ | 1.35 | 410 | 43.3 | 86.6 | 49.1 |
| 45 (Invention) | $Co(octoate)_2$ | 2.39 | 410 | 46 | 84.7 | 45.7 |
| 46 (Invention) | $Co(octoate)_2$ | 2.31 | 410 | 39.2 | 54.5 | 33.1 |
| 47 (Control) | $Fe(octoate)_3$ | 3.60 | 410 | 47.6 | 34.7 | 18.2 |
| 48 (Control) | $Fe(octoate)_3$ | 2.46 | 410 | 45.1 | 21 | 11.5 |
| 49 (Control) | $(C_5H_6)_2Fe$[12] | 0.67 | 410 | 49.6 | 20.3 | 10.2 |

Footnotes:
[1]weight-% of catalyst in a Mobilbond 120 pitch-catalyst mixture
[2]quinoline insolubles (ASTM D2318)
[3]calculated: $(100 - \text{weight loss}) \times \frac{QI}{100}$
[4]vanadium(III) acetylacetonate
[5]vanadyl(IV) acetylacetonate
[6]chromium(III) acetylacetonate
[7]nickel(II) acetylacetonate dihydrate
[8]neodymium(III) acetylacetonate
[9]vanadyl(V) naphthenate; added as a 25 weight-% solution in hexane;
[10]cobalt(II) naphthenate, added as a 6 weight-% solution in a hydrocarbon;
[11]nickel(II) naphthenate;
[12]ferrocene
[13]a portion of the quinoline insoluble material is isotropic.

Data in Table I show that the following catalysts were effective in promoting the formation of mesophase pitch from petroleum pitch: $V_2O_5$, $Cr_2O_3$, $Fe_2O_3$, $Co_3O_4$, vanadium(III) acetylacetonate, vanadyl(IV) acetylacetonate, chromium(III) acetylacetonate, nickel(II) acetylacetonate, cobalt(II) octoate, cobalt(II) naphthenate, nickel(II) octoate, nickel(II) naphthenate and $Mo(CO)_6$(molybdenum hexacarbonyl). Vanadyl(IV) acetylacetonate was the most active catalyst and was effective in increasing mesophase yield at concentrations as low as 0.26 weight-% in petroleum pitch.

EXAMPLE III

This example illustrates the use of a stirred kettle for converting petroleum pitch to mesophase pitch in quantities sufficient for spinning tests. About 300 grams of petroleum pitch (mobilbond 120) and, when used, variable amounts of catalyst were placed in a glass resin kettle of 500 ml capacity sealed with a four-neck kettle lid by means of ring clamps. Through the four openings of the kettle lid were inserted a thermocouple, a motor-driven stirrer, a nitrogen gas inlet tube and an outlet tube with attached condenser cooled with warm (70° C.) water. Three traps filled (⅔ full) with toluene were attached to the condenser for collectinb volatiles. The kettle was heated by means of an electric heating mantle with temperature controller. The nitrogen flow rate was about 0.3–0.5 standard cubic feet per minute (SCFM). Representative test results employing the described kettle setup are summarized in Table II.

TABLE II

| Run | Catalyst | Wt-% Catal | React. Temp (°C.) | React. Time (hrs) | Weight Loss (Wt-%) | QI (Wt-%) | Mesophase Yield (Wt-%) |
|---|---|---|---|---|---|---|---|
| 50 (Control) | — | — | 410 | 6 | 34.5 | 41.2 | 27 |
| 51 (Control) | — | — | 410 | 8 | 40.5 | 42 | 25 |
| 52 (Control) | — | — | 410 | 10 | 37.8 | 49.7 | 30.9 |
| 53 (Invention) | $VO(acac)_2$ | 1.0 | 410 | 3 | 33.2 | 48.6 | 32.5 |
| 54 (Invention) | $VO(acac)_2$ | 1.0 | 410 | 3 | 22.1 | 56.7 | 44.2 |
| 55 (Invention) | $VO(acac)_2$ | 1.0 | 410 | 4 | 35 | 40.2 | 26.1 |
| 56 (Invention) | $Ni(octoate)_2$ | 2.5 | 410 | 4 | 26.8 | 55.8 | 40.8 |
| 57 (Invention) | $Ni(octoate)_2$ | 2.5 | 410 | 6 | 29.5 | 65.4 | 46.1 |

Data in Table II confirm that mesophase pitch can be produced in the presence of certain transition metal compounds as catalysts in considerably shorter periods of time and at higher yields than without said catalysts.

EXAMPLE IV

This example illustrates the preparation of carbon fibers from control mesophase pitch prepared by heating petroleum pitch without any catalyst at 410° C. for about 18.5 hours and from inventive mesophase pitch prepared by heating petroleum pitch with 0.1 weight-% $VO(acac)_2$ at 410° C. for about 8 hours. The quinoline insolubles (QI) content was about 70% for control mesophase pitch and about 61% for catalyzed mesophase pitch.

About 70–100 grams of the mesophase pitch samples were heated and screened through a screen pack and extruded through a monofilament spinnerette of 0.01 inch diameter in a Fourne-Bonn piston extruder (marketed by Ernest L. Frankl Corporation, Greenville, S.C.). The melt temperature was about 340°–390° C., preferably about 360° C. The pressure ranged from ambient pressure to about 20 bar. Spun pitch fibers were wound up by a take-up wheel at a speed of about 100–400 ft/minute (depending on the piston speed).

Mesophase pitch fibers of about 1 ft of length were thermoset in a quartz tube boat placed in a tube furnace. First the fibers were heated from ambient temperature to about 250°–300° C. during a period of 30–50 minutes and then heated at the above temperature in air for about 2 hours.

Carbonization of the thermoset mesophase pitch fibers was carried out by heating them in the same furnace under a nitrogen atmosphere: from 300° C. to about 900° C. in a period of about 75 minutes and from 900° C. to about 1210° C. in a period of about 45 minutes. Subsequently the carbonized fibers were further carbonized in an Astro model 1000A-2560-FP20 graphite furnace (marketed by Astro Industries, Santa Barbara, CA) by heating at about 1800° C. for about 2 hours in a helium atmosphere.

Physical properties of carbonized (1800° C.) control fibers made from uncatalyzed mesophase pitch and of carbonized (1800° C.) invention fibers made from $VO(acac)_2$-catalyzed mesophase pitch are listed in Table III. Data in Table III are averages of five determinations. The fiber diameter was measured under a microscope at 100× magnification. Tensile parameters were determined in an Instron tensile tester.

TABLE III

| | Control | Invention |
|---|---|---|
| Fiber Diameter (microns) | 54 | 48 |
| Tensile Strength (kilo PSI) | 28 | 43 |
| Elongation (%) | 0.42 | 0.66 |
| Modulus (Mega PSI) | 7.4 | 6.5 |

Data in Table III show that the tensile strength of carbonized carbon fibers made from catalyzed mesophase pitch (Invention) was about 50% higher than that of control fibers made from uncatalyzed mesophase pitch. Also elongation and modulus are different for the two types of fibers.

What is claimed:

1. A process for the conversion of pitch to mesophase pitch which comprises heating pitch in the presence of a catalytically effective amount of a catalyst comprising a compound selected from the group consisting of oxides of vanadium, chromium, iron and cobalt, diketones of vanadium, chromium and nickel, carboxylates of nickel and cobalt and carbonyls of molybdenum at an elevated temperature of at least about 350° C. and for a period of time sufficient to convert the pitch to mesophase pitch.

2. A process according to claim 1 wherein the pitch is petroleum pitch.

3. A process according to claim 1 wherein the temperature is in the range of about 380° to about 450° and the reaction heating time ranges from about 1 to about 20 hours.

4. A process according to claim 1 wherein said heating is carried out in a non-oxidative atmosphere.

5. A process according to claim 4 wherein said atmosphere is an inert gas passed over the pitch during heating.

6. A process according to claim 1 wherein said catalyst is an oxide of vanadium, chromium, iron or cobalt.

7. A process according to claim 1 wherein said catalyst is a diketone of vanadium, chromium or nickel.

8. A process according to claim 1 wherein said catalyst is a carboxylate of nickel or cobalt.

9. A process according to claim 1 wherein said catalyst is a carbonyl of molybdenum.

10. A process according to claim 1 wherein said catalyst is at least one of $V_2O_5$, $Cr_2O_3$, $Co_3O_4$, vanadium(III) acetylacetonate, vanadyl(IV) acetylacetonate, chromium(III) acetylacetonate, nickel(II) octoate, nickel(II) naphthenate and $Mo(CO)_6$.

11. A process according to claim 1 wherein the catalyst is vanadium(III) acetylacetonate or vanadyl(IV) acetylacetonate.

* * * * *